US006805109B2

(12) United States Patent
Cowan

(10) Patent No.: US 6,805,109 B2
(45) Date of Patent: Oct. 19, 2004

(54) IGNITER CIRCUIT WITH AN AIR GAP

(76) Inventor: Thomas L. Cowan, Building 337, Gabreski Airport, P.O. Box 763, Westhampton Beach, NY (US) 11978

( * ) Notice: Subject to any disclaimer, the term of this patent is extended or adjusted under 35 U.S.C. 154(b) by 0 days.

(21) Appl. No.: 10/295,509

(22) Filed: Nov. 15, 2002

(65) Prior Publication Data

US 2004/0050377 A1 Mar. 18, 2004

Related U.S. Application Data

(63) Continuation-in-part of application No. 10/246,111, filed on Sep. 18, 2002, now Pat. No. 6,647,974.

(51) Int. Cl.[7] ..... F02P 3/06

(52) U.S. Cl. ..... 123/604; 123/622; 123/627

(58) Field of Search ..... 123/598, 604, 123/620, 627, 655, 656, 640, 606, 628, 622; 361/247, 253, 256, 257, 261

(56) References Cited

U.S. PATENT DOCUMENTS

| | | | |
|---|---|---|---|
| 4,301,782 | A | 11/1981 | Wainwright |
| 5,471,362 | A | 11/1995 | Gowan |
| 5,569,998 | A | 10/1996 | Cowan |
| 5,596,974 | A | 1/1997 | Hall et al. |
| 5,793,585 | A | 8/1998 | Cowan |
| 6,052,270 | A | 4/2000 | Kinge |
| 6,138,653 | A | 10/2000 | Juffinger |
| 6,167,875 | B1 | 1/2001 | French et al. |
| 6,305,365 | B1 * | 10/2001 | Maeoka et al. ..... 123/604 |
| 6,647,974 | B1 * | 11/2003 | Cowan ..... 123/604 |

* cited by examiner

*Primary Examiner*—John Kwon
(74) *Attorney, Agent, or Firm*—Scully, Scott, Murphy & Presser; William C. Roch, Esq.

(57) ABSTRACT

Ignition systems of the kind used to ignite a difficult-to-ignite fuel oil by using energy stored in a capacitor at a breakdown for creating an ignition arc at the electrodes of a resistive arc probe, having a semiconductor resistive film across spark electrodes of the resistive arc probe, designed to preclude interference of contaminants with conduction of an ignition arc across an established current path between the electrodes of the resistive arc probe. An air gap and a resistive arc probe are connected in series. A first high voltage power supply develops a first direct current voltage across a capacitor, which is supplied as a voltage across the air gap and the resistive arc probe. A second high voltage power supply supplies a second pulsed voltage across the air gap and the resistive arc probe, wherein the second pulsed voltage is substantially higher than the first direct current voltage, and the second pulsed voltage jumps the gap of the air gap and thus initiates an ignition arc. The first direct current voltage is current limiting thereby allowing the capacitor voltage to approach zero, and thus allowing the air gap to cease conducting, thereby allowing the cycle to repeat itself. A diode is positioned between the second pulsed voltage and the capacitor of the first high voltage power supply to isolate the capacitor from the second pulsed voltage. A second capacitor is placed parallel to the resistive arc probe to prevent the pulsed second high voltage from affecting the resistive arc probe.

12 Claims, 2 Drawing Sheets

IGNITER CIRCUIT WITH AN AIR GAP

This patent applications a continuation-in-part of patent application Ser. No. 10/246,111 now U.S. Pat No. 6,642,974, filed Sep. 18, 2002.

BACKGROUND OF THE INVENTION

1. Field of the Invention

The present invention relates generally to a capacitive discharge igniter circuit of the kind used to ignite a difficult-to-ignite fuel by using the energy stored in a capacitor which is discharged at a threshold breakdown voltage for creating an ignition arc at the electrodes of a spark plug.

A typical environment for the use of the present invention is for systems that are used to ignite extremely dirty fuels such as fuel oils. In such systems, the fuel and contaminants can tend to short the conductive path across the electrodes of simple sparking devices and plugs; (such as generated by a 10,000 volt transformer), such that the ignition current shorts out through the dirty fuel and contaminants without generating a spark at the electrodes of the spark plug to light the fuel. This problem is normally addressed in the prior art by the use of a semiconductor material placed between the electrodes of the sparking device or by the creation of a current path of low voltage potential between the electrodes of the sparking device, whereby the space about the electrodes becomes ionized to lower resistance, thereby allowing a rapid discharge of energy stored in a capacitor between the electrodes so as to provide a hot arc for fuel ignition. It is the rapid discharge of energy, stored in a capacitor, at the electrodes of the spark plug that accounts for it's ability to bum through contaminants and thereby generate an arc that can ignite the fuel.

2. Discussion of the Prior Art

U.S. Pat. No. 5,471,362 discloses an arc igniter circuit which has a spark plug connected in series with a spark gap device and a rectifier. A spark gap device is a relatively expensive component in which all oxygen is removed, often with getterers, and the device is then refilled with a specialty gas in such a manner that it establishes a characteristic of having a precise threshold breakdown voltage. It is this characteristic "break down voltage" that manages the circuit. The circuit is inoperable without it, and it would be beneficial to eliminate the expense of this component. A capacitor is connected in series with the spark gap and the spark plug. An electrical power source has a transformer with a primary winding supplied by an AC voltage and a secondary winding connected to the capacitor via a rectifier for charging the capacitor. The secondary winding is connected to the spark plug via a diode, thereby providing a current path for the spark gap at a predetermined voltage and simultaneously discharging the capacitor through the spark plug via the spark gap.

U.S. Pat. No. 5,793,585 discloses a similar arc igniter circuit having a high voltage power source connected to the power arc circuit downstream of a high voltage, high current diode, and by a relay connected between a power input and the power arc circuit, which has a series connection of a spark gap, a diode and a spark plug.

A capacitive discharge corona arc circuit of the type disclosed in U.S. Pat. Nos. 5,471,362 and 5,793,585 charges a capacitor which is then discharged through a corona arc circuit. This is an example of an arc being generated via a current path. These patents also mention and describe the prior art "resistive path" modality mentioned above. The present invention is an evolution in that type of capacitive discharge corona arc igniter circuit, and provides a secondary power source for such power arc circuits that allows the creation of the ionized area about the electrodes of a resistive type sparking device.

FIG. 1 illustrates a prior art ignition circuit wherein a main power step-up transformer T1 (typically 2,000 V and current limiting) has an input voltage of VAC and produces an output voltage V1AC which charges a storage capacitor C1 (rapid discharge, typically 6 $\mu$f at 2,000 V) through a rectifying diode D1. The capacitor C1 is then periodically rapidly discharged through a spark gap SG which is designed by a manufacturer to break down and conduct a large current, and an arc probe spark plug AP. The arc probe spark plug AP has a semiconductive resistive film across the spark plug electrodes that provides a reference ground for the discharge of the spark gap. The arc probe AP is a special type of spark plug which is designed to be in direct contact with a fuel that it is igniting, and has a semiconductive material positioned between the electrodes with a semiconductive film resistance represented as R1 in the diagram. The value of R1 can vary between a few ohms and 5 Meg ohms, and is known to change with usage.

SUMMARY OF THE INVENTION

Accordingly, it is a primary object of the present invention to provide an igniter circuit with an air gap for ignition systems of the kind used to ignite a difficult-to-ignite fuel oil by using energy stored in a capacitor which is discharged to create an ignition arc at the electrodes of a resistive arc probe spark plug.

A further object of the subject invention is the provision of a secondary power source for such power arc circuits that allows the creation of an ionized area about the electrodes of the resistive arc probe to facilitate the discharge of a stored energy source into the arc at the resistive arc probe spark plug.

The present invention advantageously uses a simple air gap, with an imprecise and irrelevant breakdown voltage, rather than a commercially available spark gap device, to eliminate the need for and expense of a commercially available spark gap device, and the costs and availability problems associated with commercially available spark gap devices. The present invention also uses a relatively simple timing circuit comprised of commercially available components to trigger its prime components.

BRIEF DESCRIPTION OF THE DRAWINGS

The foregoing objects and advantages of the present invention for an igniter circuit with an air gap may be more readily understood by one skilled in the art with reference being had to the following detailed description of several embodiments thereof, taken in conjunction with the accompanying drawings wherein like elements are designated by identical reference numerals throughout the several views, and in which.

DETAILED DESCRIPTION OF THE INVENTION

Figure 2:
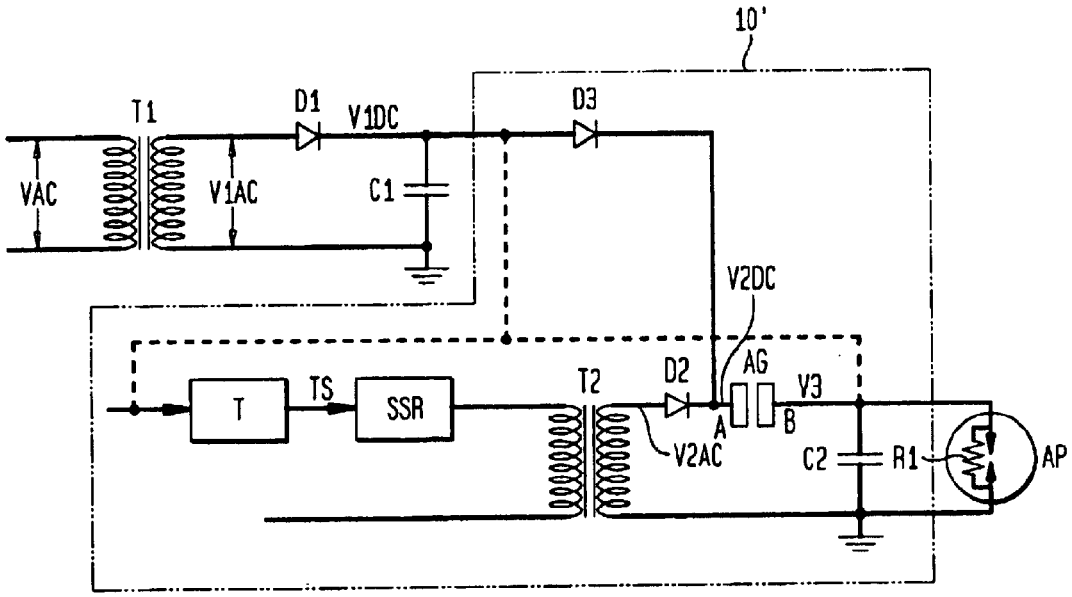
FIG. 2 illustrates a first embodiment of an igniter circuit pursuant to the present invention which uses an air gap rather than a spark gap, and which also operates with a commonly timed power supply.

FIG. 2 Illustrates a first embodiment of an igniter circuit pursuant to the present invention which uses an air gap rather than a spark gap, as in the prior art, and which also operates with a commonly timed power supply. The air gap can be sealed or exposed and has atmospheric air at atmospheric pressure between opposed electrodes thereof, with a permitted crude and wide range of breakdown values.

Figure 1:
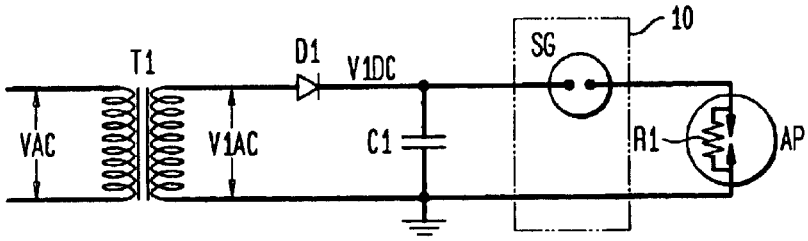
FIG. 1 (PRIOR ART)
FIG. 1 illustrates a typical prior art igniter circuit.

FIG. 2 illustrates an igniter circuit pursuant to the present invention wherein the spark gap SG within block 10 of FIG. 1 has been replaced by a novel igniter circuit pursuant to the present invention within block 10' of FIG. 2.

In the igniter circuit of FIG. 2, the charged capacitor C1 is discharged through a blocking, large current, high voltage diode D3, which prevents any positive voltage at the cathode of diode D3 from being transmitted through diode D3 to the C1, D1 circuit. The capacitor C1 is discharged through diode D3, across an air gap AG, and then through a resistive arc probe AP having a semiconductive resistance R1 across the surface of the resistive arc probe AP, which provides a conductive path across the surface to ignite difficult-to-ignite fuels in spite of an accumulation or build up of contaminants on the surface of the arc probe AP.

In the igniter circuit of FIG. 2, a trigger circuit T generates a series of trigger pulses TS as an input to trigger a solid state relay circuit SSR which provides an input to a second step up transformer T2, the output of which is directed through a diode D2 to side A of an air gap AG. The transformer T2 generates a short (only 50 ms or 0.05 seconds) low current pulse of about 0.4 ma (0.0004 amps) at approximately 7000 volts, which is a sufficiently large voltage to reliably create a spark across the air gap AG and develop a voltage on side B of the air gap AG which is an input to a capacitor C2 and the resistive arc probe AP. The air gap AG can be sealed or exposed, with a permitted crude and wide range of breakdown values. It must be triggered by a high voltage of for example 5100 volts, and allows a large current to pass therethrough.

The capacitor C2 functions as a current sink, preventing the voltage potential generated on side A of the air gap AG by the transformer T2 from materializing (being present) on side B of the air gap AG. The circuit is designed to generate only about 200 volts across the capacitor C2, although the circuit can be designed to handle higher voltages for safety and operational stability reasons.

In the igniter circuit of FIG. 2, the first transformer T1 is a commercially available component which receives a typical input of 120 VAC, and generates an output voltage V1AC of approximately 2,000 volts. The first transformer T1 is naturally current limiting, operates from a normal input power source, and is always on when the igniter circuit unit is energized. The diode D1 rectifies the 2000 V1AC to 2,000 V1DC which charges the capacitor C1, and the voltage across capacitor C1 is available through the diode D3 as an input to the air gap AG.

The second transformer T2 is a commercially available component which also receives a typical input of 120 VAC, and generates an output voltage V2AC of approximately 5,000 to 10,000 or higher volts. However, the second transformer T2 is only activated on when a trigger signal T is present to a solid state relay SSR coupled in series with the input to transformer T2.

Diodes D1, D2 are high voltage diodes which convert their input AC voltages V1AC and V2AC from AC to DC. High current diode D3 is selected and designed to have sufficient high voltage capability to prevent output voltage V2DC from backcharging the capacitor C1. The storage capacitor C1 is designed for rapid current discharging and rapid current recharging. Diodes D1, D2 and D3 could comprise more than one diode placed in parallel or series.

The solid state relay SSR is a commercially available component which is selected and designed to turn on a 100 watt circuit at a frequency between 1 and 20 HZ. Depending upon the particular circuit design, it is either an AC or DC type, and is initiated by a trigger signal TS.

The air gap AG and the series coupled electrodes of the arc probe AP present a threshold voltage such that the capacitor C1, even when fully charged by T1, cannot discharge through them until the voltage from T2 is pulsed through the air gap AG, and then the capacitor C1 discharges through the air gap AG and the ignition electrodes in the arc probe AP connected in series therewith.

The air gap AG could be sealed for safety or could be simply an air gap of about ⅛" opening between two opposed electrodes. The breakdown voltage can be variable between 4000 and 8000 volts by varying the width of the air gap.

The arc probe AP is designed to deliver a high current, short impulse, surface arc to ignite fuel oils which are difficult to ignite, and its electrodes present a gap in the circuit similar to the air gap AG with the addition of a resistive coating.

In a second embodiment of an igniter circuit pursuant to the present invention, the first transformer T1 can be replaced by a DC to DC converter circuit, wherein an input of 12 or 24 or 36 or 120 VDC is converted to an output of 2,000 VDC, and the second transformer T2 can be replaced by a DC to DC converter circuit, wherein an input of 12 or 24 or 36 or 120 VDC is converted to an output of approximately 10,000 VDC. Otherwise, the second embodiment of the igniter circuit operates in substantially the same manner as the first embodiment of the igniter.

The trigger circuit T can operate in one of three or more modes:

1) When the voltage V1 across the capacitor C1 reaches a voltage of ~2,000 VDC, the trigger signal T which is a short duration pulse having a width on the order of 5 to 20 milliseconds is then turned on, and is then turned off until V1 again reaches ~2,000 VDC.
2) Operation mode 2) is similar to operation mode 1) except that the trigger signal T is turned off when the voltage V1 across the capacitor C1 drops to a low value such as 500 volts.
3) In a third operation mode of operation, the trigger signal TS is pulsed on at a fixed rate for a finite duration, such as 4 pulses per second, with each pulse having a pulse width of approximately 20 milliseconds. In this case the capacitor's voltage could have a varied value.

In all of the operation modes, the trigger signal TS is turned on for a short period of time in an intermittent and repetitious manner to cause a spark at the air gap AG and the arc probe AP to cause a cyclical discharge of the capacitor C1.

The circuit of FIG. 2 operates with the following sequence of operations:

V1 reaches approximately 2000 VDC as the capacitor C1 is charged by the transformer T1 through the diode D1.

The voltages V2 and V3 are initially at ground potential.

The trigger circuit T applies a timing signal TS pulse to trigger the solid state relay SSR which is triggered on to apply a power pulse to the transformer T2, raising the voltage V2 and the voltage at side A of the arc gap AG towards 7000 volts via the diode D2. The timing signal TS can be controlled by number of different parameters and conditions, and is typically ON for 50 ms (0.05 seconds), and then is OFF until reinitiated, operating in a sequential manner to produce a sequential series or train of pulses TS. The solid state relay SSR is a commercially available solid state relay which is triggered by a timing signal TS and actuates and drives the transformer T2. The trigger circuit T has the logic functions to generate the timing signal TS and can be controlled by a number of different possible parameters and conditions such as: ON when V1 reaches 2000 volts, or ON by a repetitive 4 Hz timer, or OFF if V3 becomes too high, for example 1000 volts.

Before the voltage V2 reaches 7000 volts, a spark is created and jumps across the air gap AG which is shorted out.

The current from the transformer T2 then starts charging the capacitor C2.

The voltage V2 drops due to current limitation of the transformer T2.

As the current from the transformer T2 charges the capacitor C2, a voltage differential is developed between the voltages V2 and V3 of a few hundred volts: V2−V3=~+300 VDC.

The duration of the current pulse through T2 and the selection of the value of capacitor C2 is chosen such that the voltage V3 will reach only about 200 VDC.

Ignoring the current lost through the resistance R1, V3=(I×t)/C where I is the current from transformer T2 in amperes, t is the duration of the current flow in seconds, and C is the capacitance of C2 in farads. Thus where I=0.4 ma, t=50 ms, C=0.1 uf, V3 calculates to 200 volts. Therefore V3 will at most, due to T2, reach 200 volts, thus preventing T2's high voltage from reaching and affecting the arc probe AP.

The remaining circuit sequence, described next, occurs before T2 is re-pulsed.

The resistance value of the arc probe AP is R1. The value of R1 is never precise and changes with usage because it is actually a semiconductor powder imbedded in/on a ceramic material. It's value can vary from a few ohms up to 5 Meg ohms.

As V3 is now ~200 VDC, the resistance R1 of the arc probe AP conducts a little current, similar to the way R1 of FIG. 1 will conduct a little current just prior to the spark gap SG breaking down at approximately 2000 VDC. Capacitor C1 can now discharge, with the current flowing through diode D3 and air gap AG, to cause an arc at the arc probe AP, as in the prior art of FIG. 1.

As the stored energy of C1 is discharged, the voltage V1 drops due to the current limitation of the transformer T1. The current through the arc probe AP and air gap AG terminates when the low voltage of V1 is not able to sustain an ionized gap which terminates the arc at AP, as in the prior art of FIG. 1.

The cycle of operation then repeats itself as V1 starts increasing as C1 is recharged by T1.

V2 reaches 2000 VDC, and the cycle repeats itself.

The dashed or phantom lines in FIG. 2 from V1DC and V3 to the input of the trigger circuit illustrate possible control parameters which might control the trigger circuit in developing the trigger pulses TS.

The present invention also provides a very valuable function in detecting if the terminal tip of the arc probe AP has become disconnected, because without a periodic discharge through the arc probe AP, the voltage on capacitor C2 will keep increasing, and a threshold voltage can be used to trigger an alarm or notice that the terminal tip is disconnected.

Figure 3:
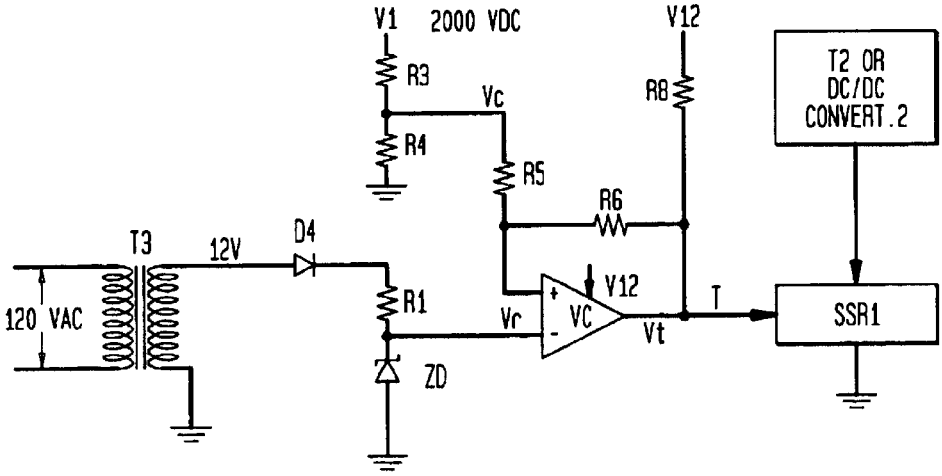
FIG. 3 illustrates an exemplary embodiment of a trigger circuit to develop an ignition trigger signal TS.

FIG. 3 illustrates an exemplary embodiment of a trigger circuit T to develop the trigger signal TS. In FIG. 3, an input transformer T3 converts an input voltage 120 VAC to 12 VAC which is rectified by a diode D4 to a 12 VDC power supply, shown as V12. A first voltage divider circuit, comprised of a resistor R1 and a Zener diode ZD, having a threshold breakdown voltage, develops a reference voltage Vr of approximately 4 volts. A second voltage divider circuit comprised of resistors R3 and R4 provides a voltage Vc representive of the capacitor voltage V1. Vc=V1/500 or 2000/500=4 volts when V1=2,000 volts. Resistors R5 and R6 provide a hysteresis such that an integrated circuit voltage comparator VC generates an output Vt=12 volts when Vc=4 volts and V1=2,000 VDC. The 12 volt signal Vt energizes the Solid State Relay SSR1, which can be connected as in FIG. 2, to cause it to conduct, and Vt=0 when Vc drops to 1 volt (V1=500 VDC), terminating conduction through the SSR1.

Auxiliary circuits can be added to the basic igniter circuits as described above for purposes of safety or component durability. The logic circuit for generating the trigger signal T might incorporate safeguards. For instance, the circuit might shut down if a current flow through the spark plug SP is not detected, which can be indicative of a faulty field hook up. Or a silicon controlled rectifier SCR or similar device can be controlled by the voltage on the capacitor C, to reduce the input power to the power source T1 to prevent an overcharge of the capacitor C. The auxiliary circuits would only serve to enhance the operability of the basic igniter circuit as described above, and would not significantly alter the main function and operation of the basic igniter circuit.

While several embodiments and variations of the present invention for an igniter circuit with an air gap are described in detail herein, it should be apparent that the disclosure and teachings of the present invention will suggest many alternative designs to those skilled in the art.

Having thus described our invention, what we claim as new and wish to secure by letters patent is:

1. An igniter circuit for a fuel ignition system designed to preclude fuel contamination from interfering with conduction of an ignition arc across an established current path between electrodes of a spark plug in the ignition system comprising:

an air gap connected in series with a resistive arc probe, having a semiconductor resistive film across spark electrodes of the resistive arc probe, wherein the resistive arc probe produces an ignition arc in a fuel to be ignited;

a first high voltage power supply for developing a first direct current voltage across a first capacitor, which is supplied as a voltage across the air gap and the resistive arc probe;

a second high voltage power supply, operating in a pulsed mode, for supplying a second pulsed voltage across the air gap and the resistive arc probe, wherein the second pulsed voltage is substantially higher than the first direct current voltage, and the second pulsed voltage is sufficient to initiate an ignition arc, and the first direct current voltage is sufficient to sustain the ignition arc, and a diode, positioned between the second pulsed voltage and the capacitor of the first high voltage power supply, to isolate the capacitor from the second pulsed voltage;

a second capacitor, coupled in parallel with the resistive arc probe, to function as a current sink to prevent the second, substantially higher pulsed voltage from the second high voltage power supply from affecting the resistive arc probe.

2. The igniter current of claim 1, wherein:

the first high voltage power supply comprises a first voltage step up transformer having a diode coupled in series therewith to provide the first direct current voltage; and the second high voltage power supply comprises a second voltage step up transformer having a pulse circuit in series with a primary winding of the second transformer to pulse operation of the second transformer.

3. The igniter current of claim 1, wherein:

the first high voltage power supply comprises a first DC to DC step-up power converter circuit for producing the first direct current voltage; and the second high voltage power supply comprises a second DC to DC step-up power converter circuit for producing the second voltage, and a pulse circuit coupled to the second high voltage power supply, to pulse the operation of the second high voltage power supply.

4. The igniter circuit of claim 2, wherein the first transformer receives a typical input of 120 VAC, and generates an output voltage V1AC of approximately 2,000 volts, is naturally current limiting, and is always on when the igniter circuit unit is energized, a diode rectifies the 2000 V1AC to 2,000 V1DC which charges the capacitor, and the voltage across the capacitor is available through a diode as an input to the air gap.

5. The igniter circuit of claim 4, wherein the second transformer receives a typical input of 120 VAC, and generates an output voltage V2AC of approximately 5,000 to 10,000 or higher volts, is only activated on when a trigger signal T is present to a solid state relay coupled in series with the input to the second transformer.

6. The igniter circuit of claim 5, wherein the solid state relay turns on a 100 watt circuit at a frequency between 1 and 20 HZ, and is initiated by the trigger signal T.

7. The igniter circuit of claim 1, wherein the second power supply operates in a pulsed mode under control of a trigger signal TS, and when the voltage across the capacitor reaches a predetermined voltage, the trigger signal TS is a short duration pulse having a width on the order of 5 to 20 milliseconds, and is then turned off until the voltage across the capacitor again reaches the predetermined voltage.

8. The igniter circuit of claim 1, wherein the second power supply operates in a pulsed mode under control of a trigger signal TS, and the trigger signal TS is turned off when the voltage across the capacitor drops to a predetermined low voltage.

9. The igniter circuit of claim 1, wherein the second power supply operates in a pulsed mode under control of a trigger signal TS, and the trigger signal TS is pulsed on at a fixed rate for a finite duration, such as 4 pulses per second, with each pulse having a pulse width of approximately 20 milliseconds.

10. The igniter circuit of claim 1, wherein the air gap is formed as a simple air gap of about ⅛" opening between two opposed electrodes.

11. The igniter circuit of claim 10, wherein the breakdown voltage of the air gap is variable between 4000 and 8000 volts by varying the width of the air gap.

12. The igniter circuit of claim 1, wherein the air gap contains atmospheric air at atmospheric pressure.

* * * * *